US006666401B1

(12) United States Patent
Mardirossian

(10) Patent No.: US 6,666,401 B1
(45) Date of Patent: Dec. 23, 2003

(54) MISSILE DEFENSE SYSTEM WITH DYNAMIC TRAJECTORY ADJUSTMENT

(75) Inventor: Aris Mardirossian, Germantown, MD (US)

(73) Assignee: Technology Patents, LLC, Derwood, MD (US)

( * ) Notice: Subject to any disclaimer, the term of this patent is extended or adjusted under 35 U.S.C. 154(b) by 0 days.

(21) Appl. No.: 10/338,021

(22) Filed: Jan. 8, 2003

(51) Int. Cl.[7] ..... F41G 7/00; F41G 7/30

(52) U.S. Cl. ..... 244/3.11; 244/3.1; 244/3.13; 244/3.14; 342/61; 342/62; 342/195; 701/3

(58) Field of Search ..... 342/61–68, 175, 342/195; 701/3–18; 89/1.11; 244/3.1–3.3

(56) References Cited

U.S. PATENT DOCUMENTS 3,982,713 A * 9/1976 Martin ..... 244/3.1
5,862,496 A * 1/1999 Biven ..... 701/3
6,262,680 B1 * 7/2001 Muto ..... 244/3.1
6,396,577 B1 5/2002 Ramstack
6,527,222 B1 * 3/2003 Redano ..... 244/3.14
6,543,716 B1 * 4/2003 Miller et al. ..... 244/3.21
6,549,158 B1 * 4/2003 Hanson ..... 342/62 X
6,563,450 B1 * 5/2003 Wallace ..... 342/62 X
6,568,628 B1 * 5/2003 Curtin et al. ..... 244/3.14
6,575,400 B1 * 6/2003 Hopkins et al. ..... 244/3.19

* cited by examiner

*Primary Examiner*—Bernarr E. Gregory
(74) *Attorney, Agent, or Firm*—Nixon & Vanderhye, PC

(57) ABSTRACT

A missile defense system includes a tracking station for monitoring the course and/or trajectory of an incoming missile. The incoming missile course and/or trajectory information is communicated to an intercept missile, whose course and/or trajectory are calculated based on the information of the incoming missile received from the tracking system and the intercept missile location received from, for example, a GPS system. The tracking system monitors the flight of the incoming missile to determine any changes to its course and/or trajectory, and communicates these changes to the intercept missile. The intercept missile adjusts its course and/or trajectory based on the updated information received from the tracking station to provide accurate and reliable intercept of the incoming missile.

14 Claims, 2 Drawing Sheets

MISSILE DEFENSE SYSTEM WITH DYNAMIC TRAJECTORY ADJUSTMENT

The present invention relates to a missile defense system. In particular, the invention is directed to a missile defense system employing intercept missiles that are programmed to intercept and destroy incoming missiles, wherein the course and trajectory of the intercepting missile is dynamically adjusted in near real-time based on information received from an incoming missile tracking station. The adjustment in course and trajectory of the intercept missile provides improved accuracy, reliability and success rates for a missile intercept system.

BACKGROUND AND SUMMARY OF THE INVENTION

A conventional missile defense system typically includes one or more missiles designed to intercept and destroy an incoming missile launched by a hostile force. The course and trajectory of these intercept missiles generally provides an initial intercept course calculated based on trajectory information relating to the incoming missile that is obtained by tracking the incoming missile. However, such intercept course and trajectory information is typically not accurate or reliable enough to ensure a strike on the incoming missile. This information is only useful in the initial stages of the intercept process, and is most valuable if the course and trajectory of the incoming missile does not change after the intercept missiles have been launched.

Realizing this shortcoming, designers of conventional missile intercept systems use additional means to adjust the course and trajectory of the intercept missiles when the intercept missiles come within a predetermined range of the incoming missile. For example, the intercept missiles may typically include heat-seeking (e.g. infrared) and/or radar based tracking technologies. Thus, when a conventional intercept missile is within a range in which these additional tracking means are useful, course adjustments may be made using these technologies.

Unfortunately, these conventional tracking technologies are easily circumvented using well known technologies. For example, when an incoming missile detects an intercept missile (or other object) within a predetermined range, the targeted missile may release various countermeasures to confuse and misguide the intercept missile. For example, the incoming missile may release chaff that includes metallic shavings that may counter radar based tracking systems, or flares that may circumvent heat-seeking or infrared tracking systems. Use of these types of countermeasures often confuse the navigation systems of the intercept missiles, causing them to miss completely and/or detonate at an improper time or location.

Moreover, because programming the initial course and trajectory of an intercept missile is based only on initial tracking data, if the trajectory or course of the incoming missile changes during flight, conventional intercept systems are ill equipped to adjust their trajectory during flight to accommodate such a change in target path.

Recently, numerous test failures involving these types of conventional missile defense systems have been reported. Either the intercept missile entirely misses the intended target, or the detonation of the intercept missile is not sufficient to destroy or disable the incoming missile.

It is well known that many conventional munitions, such as, for example, so-called "smart bombs" include circuitry that enables them to be guided to their intended (stationary) target location using information from global positioning system (GPS) satellites. For example, coordinates of an intended target may be input into the guidance or navigation system of the munition, and the guidance or navigation system may perform periodic checks during flight to ensure that its real-time position is correct, and to ensure proper trajectory and course. This is relatively straightforward when dealing with a stationary target.

The present invention envisions an exemplary missile defense system in which the intercepting missiles are updated with information from a tracking system to dynamically adjust its trajectory and course in-flight substantially in real-time. This type of continuous dynamic course adjustment will provide advantages over conventional missile defense systems and will not be subject to the same types of simple countermeasures that are currently available. Moreover, the exemplary missile defense system of the present invention may include GPS receiving technology to provide further efficiency and accuracy with respect to the dynamic course and trajectory adjustments.

The intercept missiles of the present invention may be provided with circuitry, such as, for example, a navigation computer, that enables information from the incoming missile tracking stations to be used to adjust the course and trajectory of the intercept missile in substantially real-time, as needed. Inputs to the course and trajectory correction circuitry may include, for example, a receiver for receiving information regarding the course and trajectory of the incoming missile from a tracking station, and position location information that may be included in conjunction with GPS data for enhanced accuracy.

Additionally, the intercept missile may be a munition that includes a negatively charged palette of explosives that would, upon release from the intercepting missile be attracted to the incoming missile, whereupon detonation should result in destruction, detonation, or disability of the incoming missile. For example, the incoming missile will typically have a positive charge on its hull due to friction caused by high speed passage through the atmosphere. A negatively charged palette of explosives would therefore be attracted to the positively charged hull of the incoming missile. The negatively charged palette may then attach itself to the hull of the incoming missile, or be detonated in close proximity to the incoming missile, thereby disabling, disarming or destroying the incoming missile. Alternatively, an explosive released by the intercept missile may be detonated at a location proximate the incoming missile path without using a negatively charged palette. For example, the explosive, upon detonation, could release sufficient amounts of a disabling agent, such as, for example, flak, to cover a sufficient area that, if passed through by an incoming missile, would cause the incoming missile to detonate or otherwise become disabled or disarmed. The detonation location of the explosive palette of the intercept missile may be precisely determined using the GPS system information and/or the trajectory and course adjustment system of the missile defense system of the present invention.

To that end, an exemplary embodiment of the present invention is directed to a missile defense system including at least one intercept missile, the missile defense system comprising an incoming missile tracking system for detecting the launch or identifying an incoming missile, and determining the course and/or trajectory of the incoming missile, a communication system for receiving incoming missile information from the incoming missile tracking system and transmitting course and trajectory information to the intercept missile, this course and trajectory information being based on the incoming missile information, circuitry for adjusting the course and trajectory of the intercept missile based on the incoming missile information and the location of the intercept missile received from on-board GPS receiver circuitry in substantially real-time.

A method of providing missile defense is also contemplated, the method comprising identifying an incoming missile, continuously monitoring said incoming missile to determining a course and trajectory of said incoming missile and any changes thereto, transmitting said course and trajectory information of said incoming missile to a receiving station, transmitting intercept course and trajectory information to an intercept missile, said intercept course and trajectory information being based on said course and trajectory of said incoming missile, and dynamically adjusting said intercept course and trajectory information in substantially real-time, based on the continuously monitored course and trajectory information of said incoming missile.

BRIEF DESCRIPTION OF THE DRAWINGS

The invention will be described in detail herein with reference to the following drawings in which like reference numerals refer to like elements, and wherein.

DETAILED DESCRIPTION OF EXEMPLARY EMBODIMENTS

Figure 1:
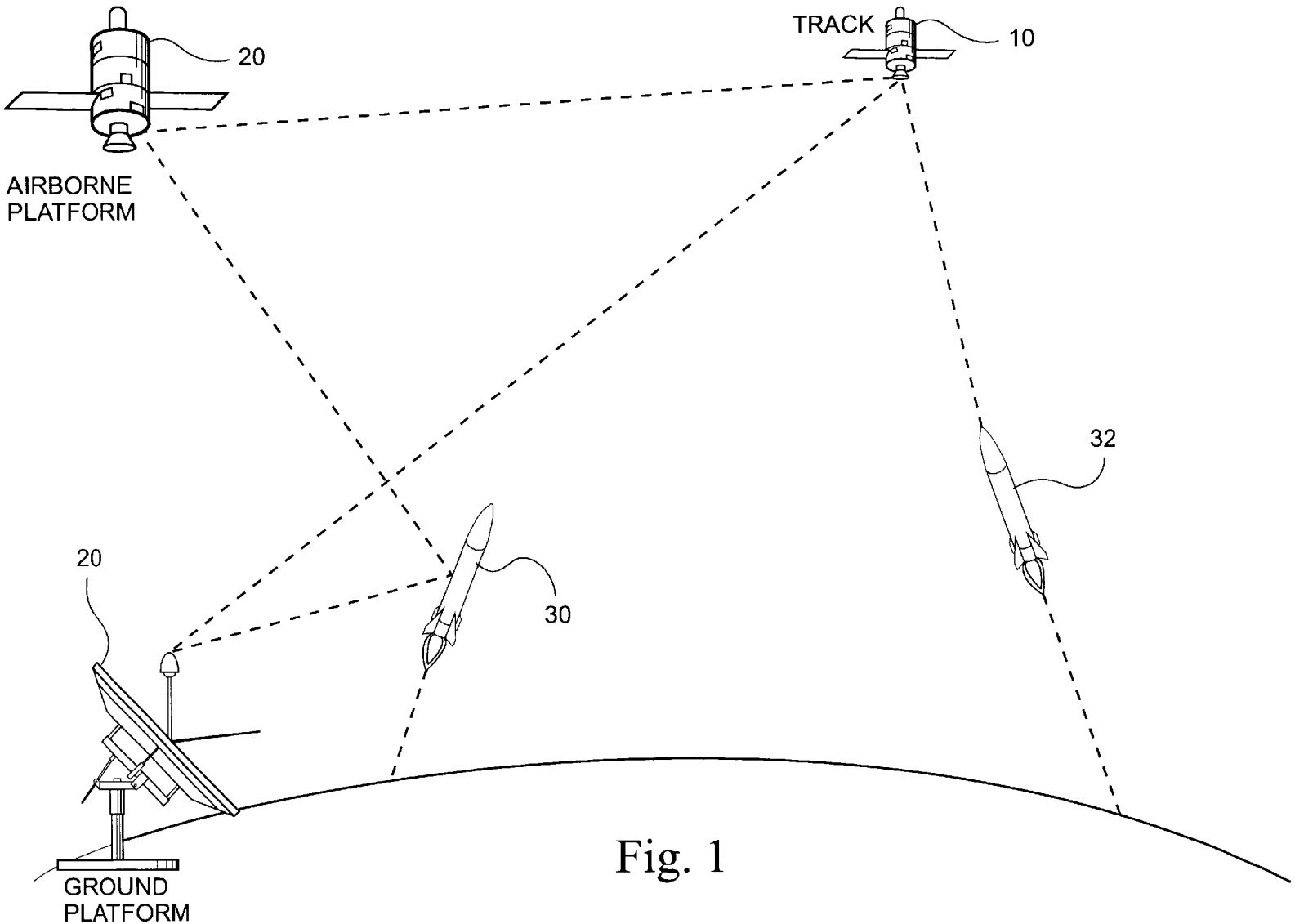
FIG. 1 is an illustrative diagram of an exemplary embodiment of the present invention.

FIG. 1 is an illustrative diagram showing an overview of an exemplary missile defense system according to the present invention. The system may include, for example, an incoming missile tracking and detection system 10 that may be realized on, for example, a satellite platform. It will be understood that the tracking system 10 may also be incorporated in a ground-based system. The tracking station 10 is preferably in communication with a receiving station 20 that may be either a ground-based or airborne platform, such as, for example, a satellite. The receiving station 20 may also be integral with the tracking station 10.

The receiving station 20 receives tracking information, such as, for example, course, trajectory and location information, relating to an incoming missile 32 from the tracking station 10 via any of a variety of communications techniques, for example, radio, dedicated hard wire, etc. The receiving station 20 also transmits the incoming missile information using any available communications technique to an intercept missile 30. This incoming missile information is used to determine navigation information for the intercept missile 30, such as, for example, course and trajectory information for the intercept missile 30, location information of the incoming missile 32, changes in course and trajectory of the incoming missile 32, etc.

Figure 2:
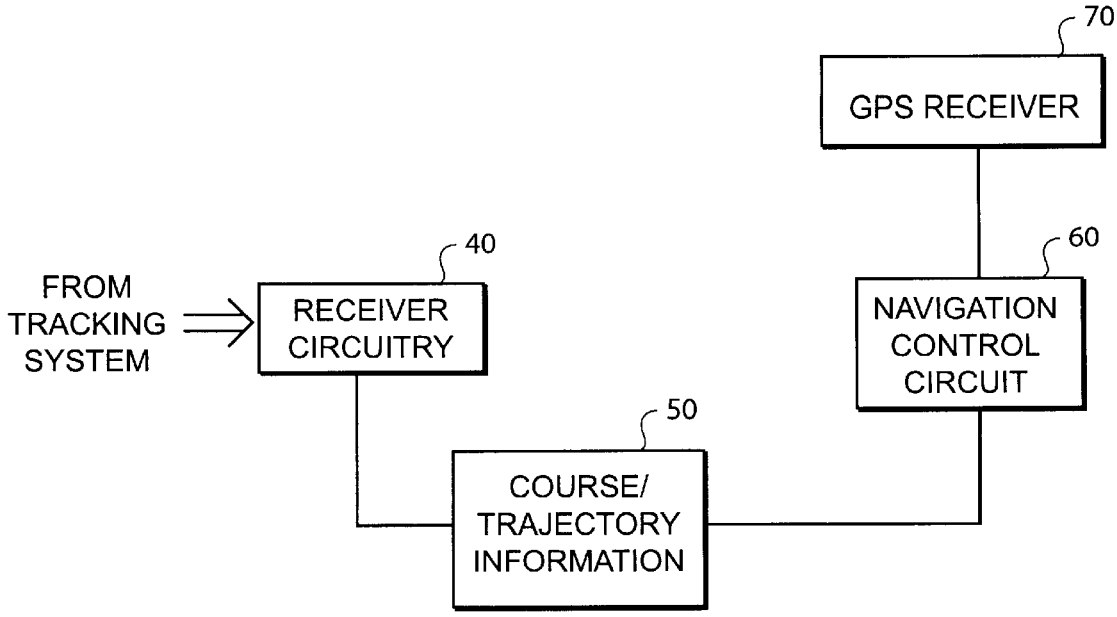
FIG. 2 is a block diagram of circuitry of an intercept missile related to an exemplary embodiment of the present invention.

FIG. 2 is a block diagram of exemplary internal components of an intercept missile according to an exemplary embodiment of the present invention. The components of each intercept missile 30 include, for example, a receiver 40 that receives information from the receiving station 20, such as, for example, course and trajectory information. The receiver 40 is in communication with an on-board navigation circuit 60, such as, for example, a navigation computer, via a course and trajectory information circuit 50. In a preferred exemplary embodiment, the intercept missiles 30 include an on-board GPS receiver 70 that preferably is in communication with the navigation circuitry 60. The GPS receiver 60 provides substantially real-time (e.g. nanosecond level) position information of the intercept missile 30 to the navigation circuitry 60.

Operation of an exemplary embodiment of the present invention will be described herein with reference to a single intercept missile 30 for ease of description. However, it will be understood that a redundant system having plural, for example two to five, intercept missiles 30 for each incoming missile 32 is preferred. In operation, the missile defense system of an exemplary embodiment of the invention described herein provides substantially real-time trajectory and course information to an intercept missile 30 based on the trajectory and course information of the incoming missile. It will be understood that the tracking system 10 of the present invention continuously monitors and tracks the incoming missile 32 and detects any changes in trajectory and course. This information is then used to provide navigation correction information to the intercept missile 30 as necessary, thereby providing an increased probability of a successful incoming missile intercept.

For example, a satellite missile tracking system 10, operated by an appropriate governmental agency, monitors the earth for missile launches. In this exemplary embodiment, the satellite 10 monitors for inter-continental ballistic missile (ICBM) launches. Upon detection of an ICBM 32 launch, the tracking station 10 notifies the receiving station 20. Additionally, either tracking station 10 or the receiving station 20 calculates the course, trajectory and location of the identified incoming ICBM 32. Upon confirmation of detection of an incoming ICBM 32, the receiving station 20 (or any other authorized agency) issues a command to launch, for example up to four, intercept missiles 30.

The intercept missiles 30 are initially launched according to a predetermined navigation path. In an exemplary embodiment, the intercept missiles 30, are preferably launched at a slightly less than vertical launch angle (directed slightly toward the direction from which the detected ICBM 32 is coming). While the intercept missiles 30 are gaining altitude, the tracking station 10 or the receiving station 20 determines a navigational path for intercepting the ICBM 32. This navigation information is transmitted to the receiving circuits 40 of the intercept missiles 30. The navigation computer 60 then causes the intercept missiles to achieve the proper trajectory and course for intercepting the incoming ICBM 32. The navigation computer 60 of course takes the position of each of the intercept missiles 30 into account to ensure proper course calculation. The position of each intercept missile 30 is provided to its navigation computer 60 by the on-board GPS receiver 70.

During the flight of the intercept missiles 30, the course and trajectory information of the incoming ICBM 32 are continuously monitored by the tracking station 10. The information from the tracking station 10 is used to continuously update the information at the receiving station 20. The receiving station 20 then transmits course correction information to the navigation computers 60 of the intercept missiles 30 via the receiving circuits 40. The precise location of each of the intercept missiles 30 is also continuously updated via the GPS receivers 70 and communicated to the navigation computers 60 for inclusion in the course and trajectory corrections.

In this manner, the course and trajectory of the intercept missiles 30 is continuously updated and adjusted, as necessary, until such time as detonation of the intercept missiles 30 is indicated. This system and method of course correction provides substantially real-time navigation adjustment to the intercept missiles 30 and is not subject to known countermeasure techniques, such as, for example, chaff and flares, that commonly frustrate conventional intercept missiles.

While the dynamic navigation adjustment described above provides improved intercept efficiency and accuracy, redundant munitions may be used to further enhance the probability of success. For example, the intercept missiles 30 may be provided with negatively charged palette of explosive ordnance. This ordnance may be ejected from the intercept missiles 30 when the system determines that proximity of the intercept missiles 30 to the path of the incoming ICBM 32 is appropriate for such release. Upon release, the negatively charged explosive palette is attracted to the positively charged metallic hull of the ICBM 32. As set forth above, the hull of the ICBM 32 will obtain a positive charge by virtue of its passage through the atmosphere at high speed. In a preferred embodiment, the charged explosive may be propelled toward the ICBM 32 in a first stage, analogous to the first stage of a two-stage rocket propelled explosive, and thereupon attach itself to the hull of the ICBM 32, or be detonated in sufficiently close proximity to the ICBM 32. Once the explosive attaches itself to the ICBM 32 or is sufficiently close to the ICBM 32 to be detonated, the explosive is detonated, thereby destroying or rendering the ICBM 32 inoperative. Alternatively, the second stage of the explosion, i.e., detonation of the explosive, may be delayed until triggered by a predetermined event, for example, when the negatively charged palette comes in contact with the hull of the ICBM 32, or upon indication by a proximity sensor that the explosive charge is in an appropriate area for detonation.

While this invention has been described in conjunction with specific embodiments thereof, it is evident that many alternatives, modifications and variations will be apparent to those skilled in the art. Accordingly, the preferred embodiments of the invention, as set forth herein, are intended to be illustrative, not limiting. Various changes may be made without departing from the true spirit and full scope of the invention, as defined in the following claims.

What is claimed is:

1. A missile defense system including at least one intercept missile, the missile defense system comprising:

an incoming missile tracking system for detecting the launch of or identifying an incoming missile, and monitoring said incoming missile to determine at least one of a course and trajectory of the incoming missile, including any changes in course or trajectory of the incoming missile;

a communication system for receiving incoming missile information from the incoming missile tracking system, and transmitting at least one of initial course and trajectory information to the intercept missile, the transmitted information being based on incoming missile information;

circuitry for adjusting at least one of the course and trajectory of the intercept missile based on updated incoming missile information and a current location of the intercept missile.

2. A missile defense system according to claim 1, wherein the intercept missile comprises:

circuitry for receiving incoming missile information from said communication system;

a GPS receiver for providing substantially real-time location data of said intercept missile; and circuitry for providing navigational control of said intercept missile based on said updated incoming missile information and a current location of the intercept missile based on said location data from said GPS receiver.

3. A missile defense system according to claim 2, wherein said circuitry for providing navigational control to said intercept missile is a navigational computer.

4. A missile defense system according to claim 2, wherein said intercept missile further comprises a negatively charged palette of explosives.

5. A missile defense system according to claim 4, wherein said negatively charged palette of explosives comprises a two-stage propulsion system.

6. A missile defense system according to claim 1, wherein said incoming missile tracking system is a satellite based system.

7. A missile defense system according to claim 3, wherein said communication system is a ground based system.

8. A missile defense system according to claim 1, wherein said incoming missile tracking system and said communication system are integral with each other on a common platform.

9. A missile defense system according to claim 8, wherein said common platform is a satellite based platform.

10. A missile defense system according to claim 1, wherein said circuitry for adjusting at least one of the course and trajectory of the intercept missile performs said adjustment in substantially real-time.

11. A method of providing missile defense, comprising:

identifying an incoming missile;

monitoring said incoming missile to determine at least one of a course and trajectory of said incoming missile, and any changes thereto;

transmitting at least one of said course and trajectory information of said incoming missile and any changes thereto to an intercept missile;

launching an intercept missile; and dynamically adjusting at least one of a course and trajectory of said intercept missile based on at least one of said course and trajectory information of said incoming missile and any changes thereto.

12. A method according to claim 11, wherein said step of dynamically adjusting at least one of the course and trajectory of said intercept missile occurs substantially in real time, and is further based on a location of said intercept missile determined by a GPS system.

13. A method according to claim 11, further comprising ejecting an explosive from said intercept missile at a predetermined time.

14. A method according to claim 13, wherein said explosive is carried on a negatively charged palette, said palette being propelled by a two-stage propulsion system.

* * * * *